US009461417B2

(12) United States Patent
Zhang

(10) Patent No.: US 9,461,417 B2
(45) Date of Patent: Oct. 4, 2016

(54) ELECTRICAL CONNECTOR ASSEMBLY WITH A LIGHT GUIDE MEMBER

(71) Applicant: DONGGUAN XUNTAO ELECTRONIC CO., LTD., Dongguan, Guangdong Province (CN)

(72) Inventor: Wen-Chuan Zhang, Dongguan (CN)

(73) Assignee: DONGGUAN XUNTAO ELECTRONIC CO., LTD., Dongguan, Guangdong Province (CN)

( * ) Notice: Subject to any disclaimer, the term of this patent is extended or adjusted under 35 U.S.C. 154(b) by 0 days.

(21) Appl. No.: 14/583,704

(22) Filed: Dec. 27, 2014

(65) Prior Publication Data

US 2016/0134063 A1 May 12, 2016

(30) Foreign Application Priority Data

Nov. 11, 2014 (CN) ..... 2014 2 0675261 U

(51) Int. Cl.

| | |
|---|---|
| ***H01R 3/00*** | (2006.01) |
| ***H01R 13/717*** | (2006.01) |
| ***H01R 13/70*** | (2006.01) |
| ***H01R 43/02*** | (2006.01) |
| ***H01R 13/62*** | (2006.01) |

(52) U.S. Cl.

CPC ..... *H01R 13/7175* (2013.01); *H01R 13/6205* (2013.01); *H01R 13/70* (2013.01); *H01R 43/0207* (2013.01)

(58) Field of Classification Search

CPC ..... H01R 13/7175; H01R 13/717; H01R 13/6641; H01R 13/641; H01R 23/025; H01R 13/6658; H01R 13/658; H01R 23/7068; H01R 31/06

USPC ..... 439/490, 76.1, 39

See application file for complete search history.

(56) References Cited

U.S. PATENT DOCUMENTS

| | | | | |
|---|---|---|---|---|
| 5,469,841 A * | 11/1995 | Kobayashi | A61B 1/00124 | 600/158 |
| 6,095,851 A * | 8/2000 | Laity | H01R 13/7172 | 439/490 |
| 6,264,499 B1 * | 7/2001 | Costello | H01R 13/6641 | 385/92 |
| 6,319,051 B1 * | 11/2001 | Chang | H01R 13/6641 | 439/488 |

(Continued)

FOREIGN PATENT DOCUMENTS

| | | |
|---|---|---|
| CN | 2449385 Y | 9/2001 |
| CN | 102761035 A | 10/2012 |

*Primary Examiner* — Abdullah Riyami
*Assistant Examiner* — Vladimir Imas
(74) *Attorney, Agent, or Firm* — Cheng-Ju Chiang

(57) ABSTRACT

An electrical connector assembly includes a connector, an inner printed circuit board, and a light guide member made of transparent or semitransparent material. The connector comprising an insulative housing and a plurality of contacts received in the insulative housing, and each contact has a contacting portion and a soldering portion. The inner printed circuit board is welding with the soldering portions of the contacts and defines an LED. The light guide member is neighboring to the LED and exposed out of the electrical connector assembly. The inner printed circuit board defines a control module thereon for controlling the LED on or off and a touch switch arranged in front of the control module, the LED is electrically connected with the control module and the touch switch.

20 Claims, 6 Drawing Sheets

(56) References Cited

U.S. PATENT DOCUMENTS 6,334,787 B1 * 1/2002 Chang ..... H01R 13/6641 439/490
6,336,825 B1 * 1/2002 Seefried ..... G02B 6/4204 439/488
6,428,361 B1 * 8/2002 Imschweiler ..... H01R 13/6658 439/490
6,457,992 B2 * 10/2002 Posey ..... H01R 13/60 439/131
6,699,065 B1 * 3/2004 Espenshade ..... H01R 13/641 439/490
6,752,649 B2 * 6/2004 Arkin ..... H01R 31/065 439/491
6,962,446 B2 * 11/2005 Greub ..... G02B 6/25 385/134
6,984,155 B1 * 1/2006 Liu ..... H01R 24/64 439/490
7,347,579 B2 * 3/2008 Kohama ..... A44B 11/2523 362/103
7,393,237 B2 * 7/2008 Kuo ..... H01R 13/6691 362/249.01
7,419,275 B2 * 9/2008 Huang ..... B43K 23/12 362/118
7,628,619 B2 * 12/2009 Chuang ..... H01R 13/6658 439/620.08
7,828,528 B2 * 11/2010 Estes ..... A61M 5/14244 417/43
7,828,569 B2 * 11/2010 Aronson ..... H01R 27/00 439/218
7,976,336 B2 * 7/2011 Yang ..... H01R 13/6658 439/490
8,016,621 B2 * 9/2011 Bopp ..... H01R 13/6658 439/676
8,287,302 B2 * 10/2012 Aguren ..... H01R 13/641 439/490
8,303,333 B2 * 11/2012 Lee ..... H01R 13/7175 439/488
8,382,346 B2 * 2/2013 Schultheis ..... B60Q 3/001 362/282
8,434,909 B2 * 5/2013 Nichol ..... G02B 6/0018 362/296.01
8,638,233 B2 * 1/2014 Aguren ..... G02B 6/4292 340/815.42
8,646,194 B2 * 2/2014 Podd ..... H05B 37/029 362/249.12
8,648,735 B2 * 2/2014 Haynes ..... G08G 1/09 119/859
8,820,949 B2 * 9/2014 Takeda ..... H01H 13/83 362/23.03
8,876,352 B2 * 11/2014 Robbins ..... F21K 9/00 362/488
9,028,122 B2 * 5/2015 Tuchrelo ..... H01R 13/7175 362/253
9,028,123 B2 * 5/2015 Nichol ..... G02B 6/0018 349/63
9,065,205 B2 * 6/2015 Gao ..... H01R 13/5808
9,160,118 B2 * 10/2015 Tuchrelo ..... H01R 13/665
2004/0038582 A1 * 2/2004 Clement ..... H01R 13/5812 439/467
2007/0268688 A1 * 11/2007 Chen ..... F21L 4/085 362/183
2010/0309657 A1 * 12/2010 Purdy ..... F21L 4/005 362/200
2011/0256769 A1 * 10/2011 Wu ..... H01R 13/6658 439/620.02
2013/0308304 A1 * 11/2013 Tuchrelo ..... H01R 13/7175 362/157

* cited by examiner

ELECTRICAL CONNECTOR ASSEMBLY WITH A LIGHT GUIDE MEMBER

BACKGROUND OF THE INVENTION

1. Field of the Invention

The present invention relates to an electrical connector assembly, and more particularly, to an electrical connector assembly with a light guide member.

2. Description of Related Art

Recently, with the popularity of personal computers (PC), computer peripheral equipments include standard equipment such as keyboards and mouse devices, office equipment such as printers and scanners, personal entertainment equipment such as digital cameras, smart phone and tablet, can connect with PC to achieve signal transmission and charging. However, computer peripheral equipments have different interfaces, each peripheral equipment is mating with a corresponding port of the PC in use, and different peripheral equipments must be actuated by corresponding driver software. Therefore, Universal Serial Bus (USB) is a serial bus standard to the PC architecture with a focus on computer telephony interface, consumer and productivity applications. USB can connect peripherals such as mouse devices, keyboards, PDAs, gamepads and joysticks, scanners, digital cameras, printers, external storage, networking components, etc. The peripheral equipments are connected with the PC via a USB plug mating with a USB receptacle.

The USB plug is usually connected with a cable, and exposed out of the PC, so may be interfered by external factors easily, such as touching, drawing or extrusion by peoples or animals, hence may led to an interrupt of communication signals. And users can't judge whether the USB plug in working condition.

CN patent publication No. 2449385Y discloses a luminous USB cable connector assembly with an indication function, and the USB cable connector assembly is connected between a PC and a hub, or between a hub and a peripheral equipment, the USB cable connector assembly has a cover made of translucent material, and a plurality of contacts with tail portions connected with a printed circuit board. A Light Emitting Diode (LED) assembly is arranged on the printed circuit board, and two feet of the LED are connected with the positive and negative power supply circuit of the USB cable connector assembly in parallel way. When the USB cable connector assembly mating with a port of the PC, the LED assembly can be illuminated via power of the PC, and light from the LED assembly can be transmitted directly through the cover, for indicating work status of the USB cable connector assembly whether a connection therebetween is on or off.

BRIEF SUMMARY OF THE INVENTION

The present invention provides an electrical connector assembly including a connector, an inner printed circuit board, and a light guide member made of transparent or semitransparent material. The connector comprising an insulative housing and a plurality of contacts received in the insulative housing, and each contact has a contacting portion and a soldering portion. The inner printed circuit board is welding with the soldering portions of the contacts and defines an LED. The light guide member is neighboring to the LED and exposed out of the electrical connector assembly. The inner printed circuit board defines a control module thereon for controlling the LED on or off and a touch switch arranged in front of the control module, the LED is electrically connected with the control module and the touch switch.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
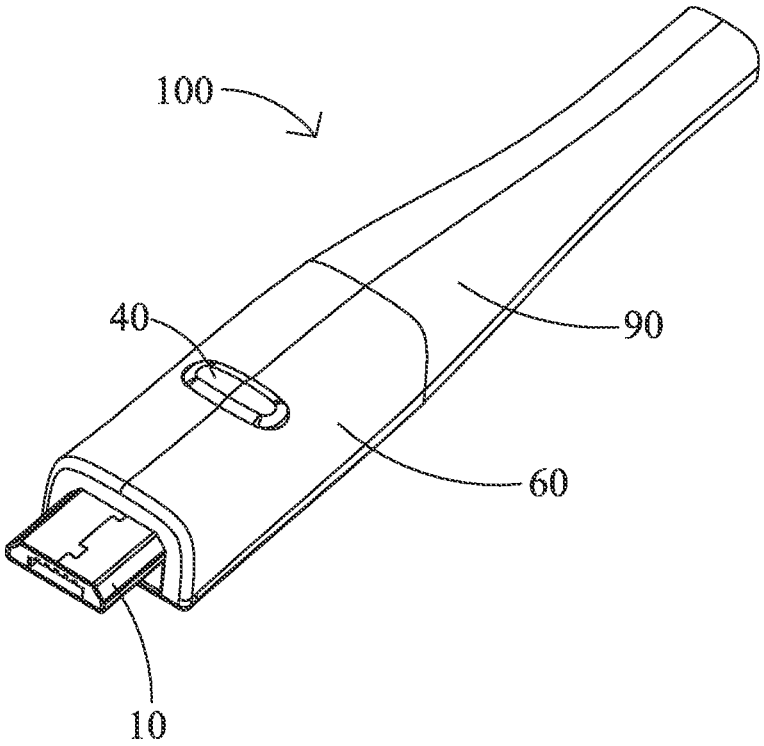
FIG. 1 is a perspective view of an electrical connector assembly in accordance with the present invention.

Reference will now be made to the drawing figures to describe the embodiments of the present invention in detail. In the following description, the same drawing reference numerals are used for the same elements in different drawings.

Figure 2:
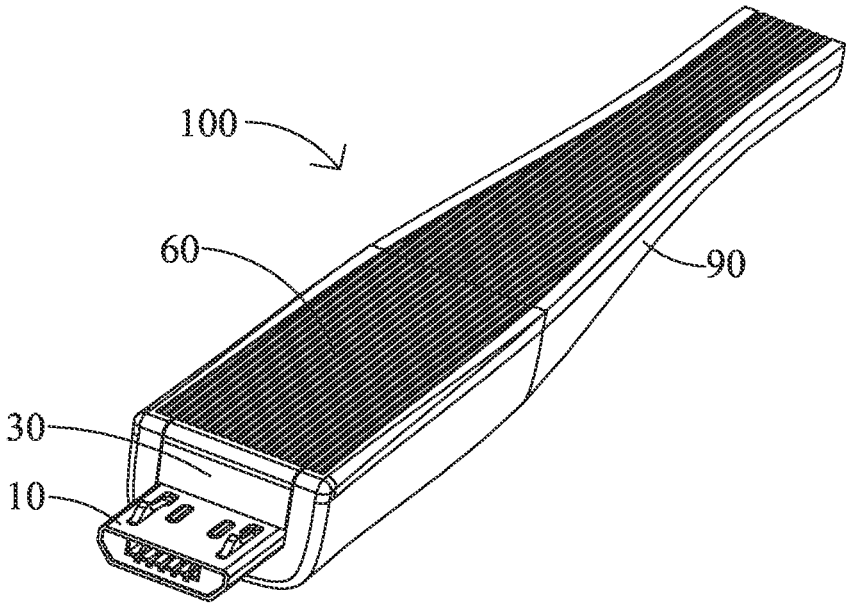
FIG. 2 is a view similar to FIG. 1, but viewed from a different aspect.
Figure 3:
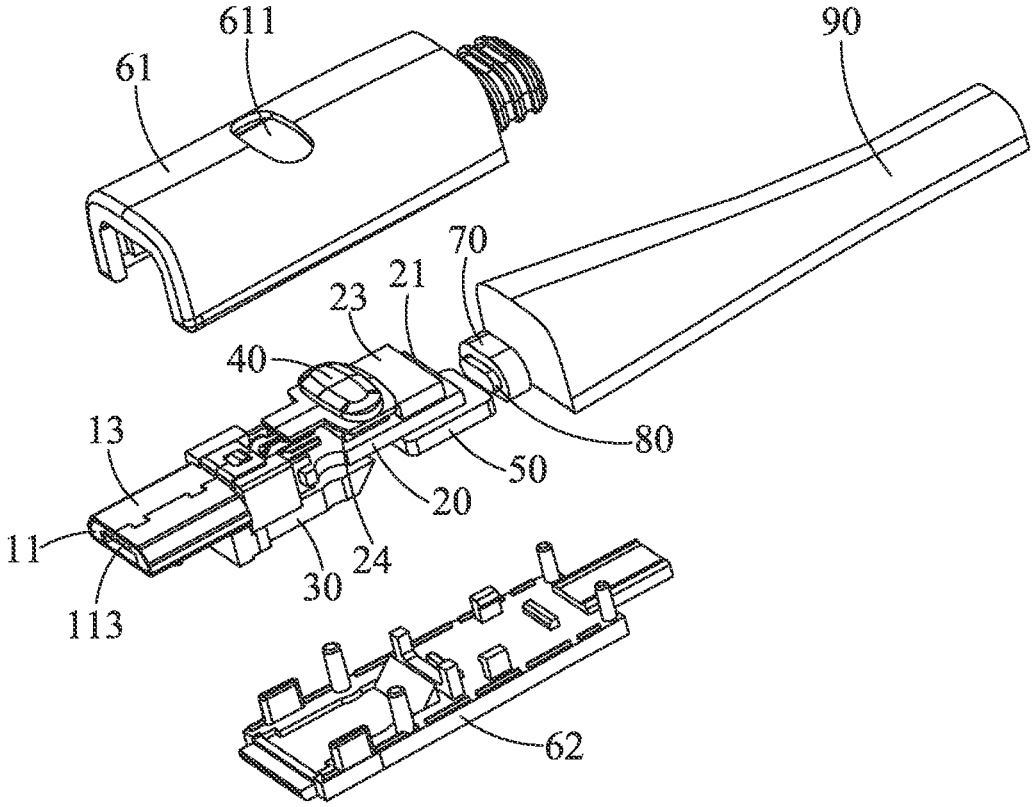
FIG. 3 is a partially exploded view of the electrical connector assembly shown in FIG. 1.
Figure 4:
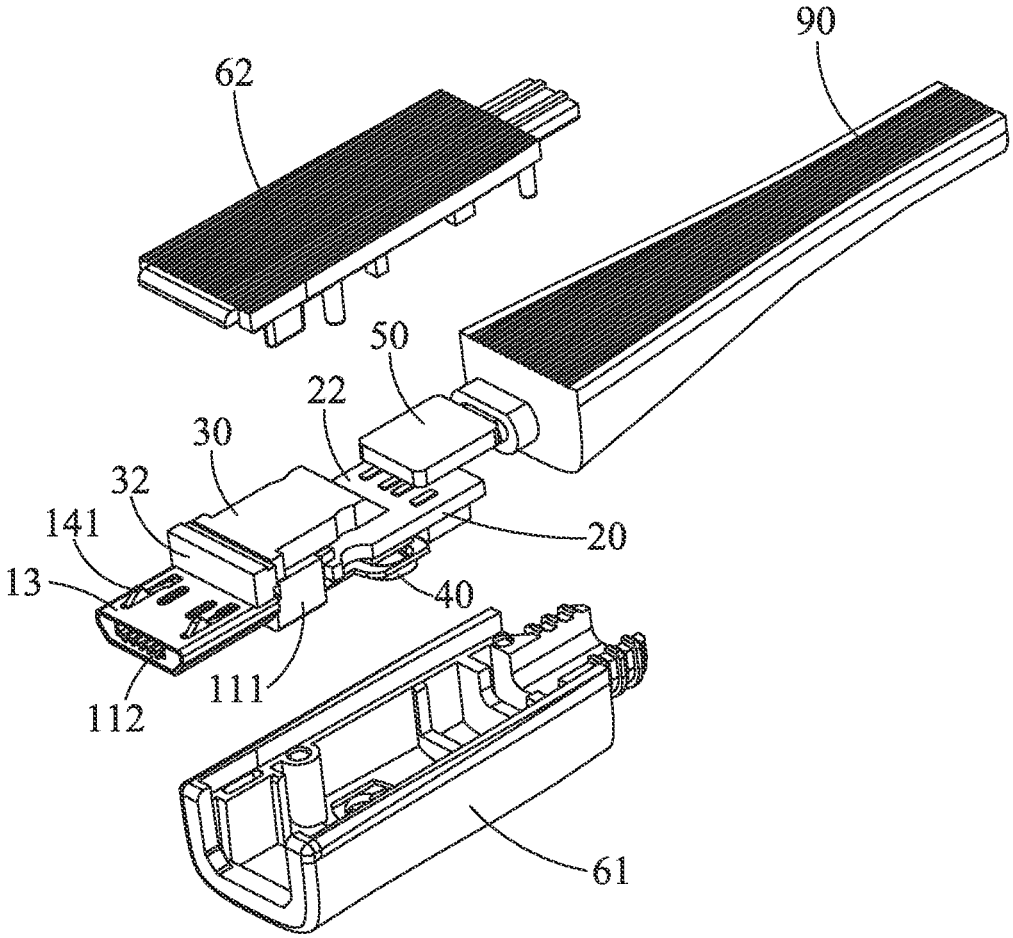
FIG. 4 is a view similar to FIG. 3, but viewed from a different aspect.
Figure 5:
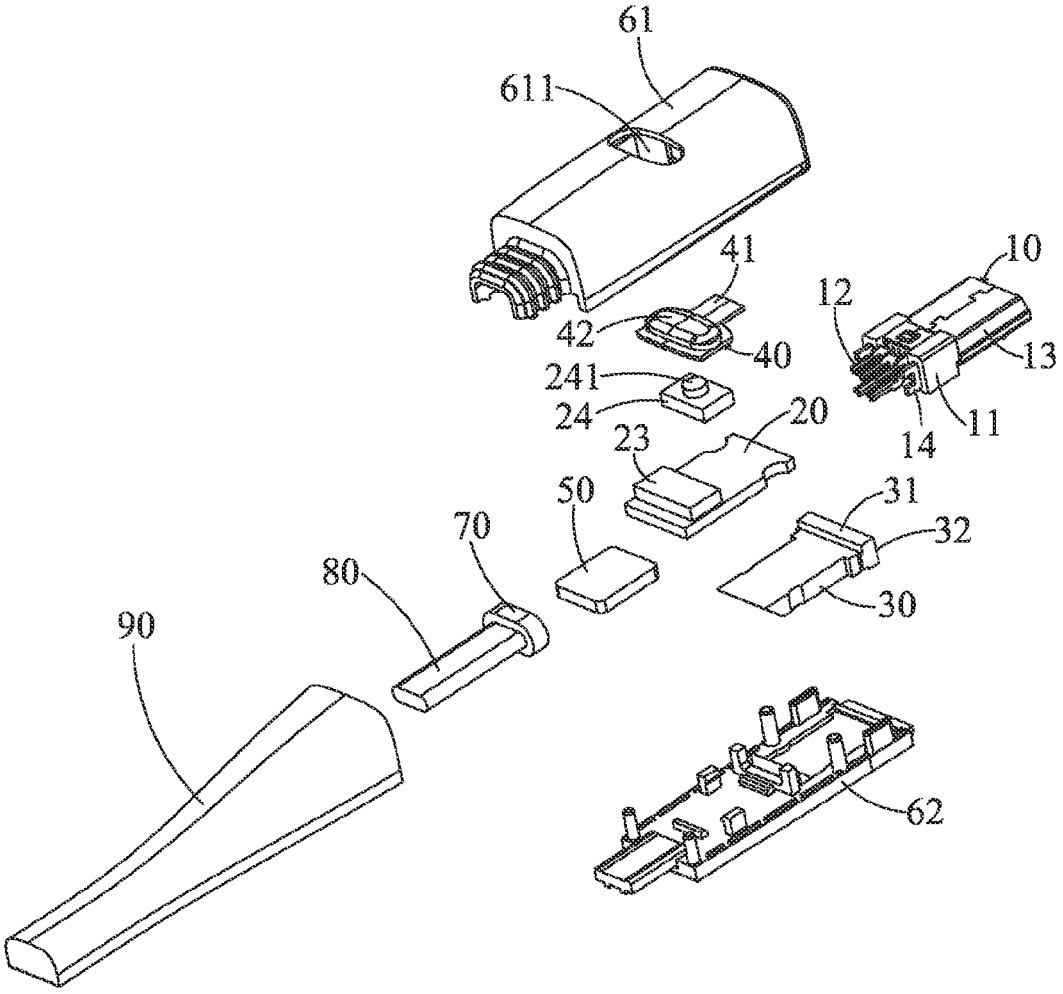
FIG. 5 is an exploded, perspective view of the electrical connector assembly shown in FIG. 1.
Figure 6:
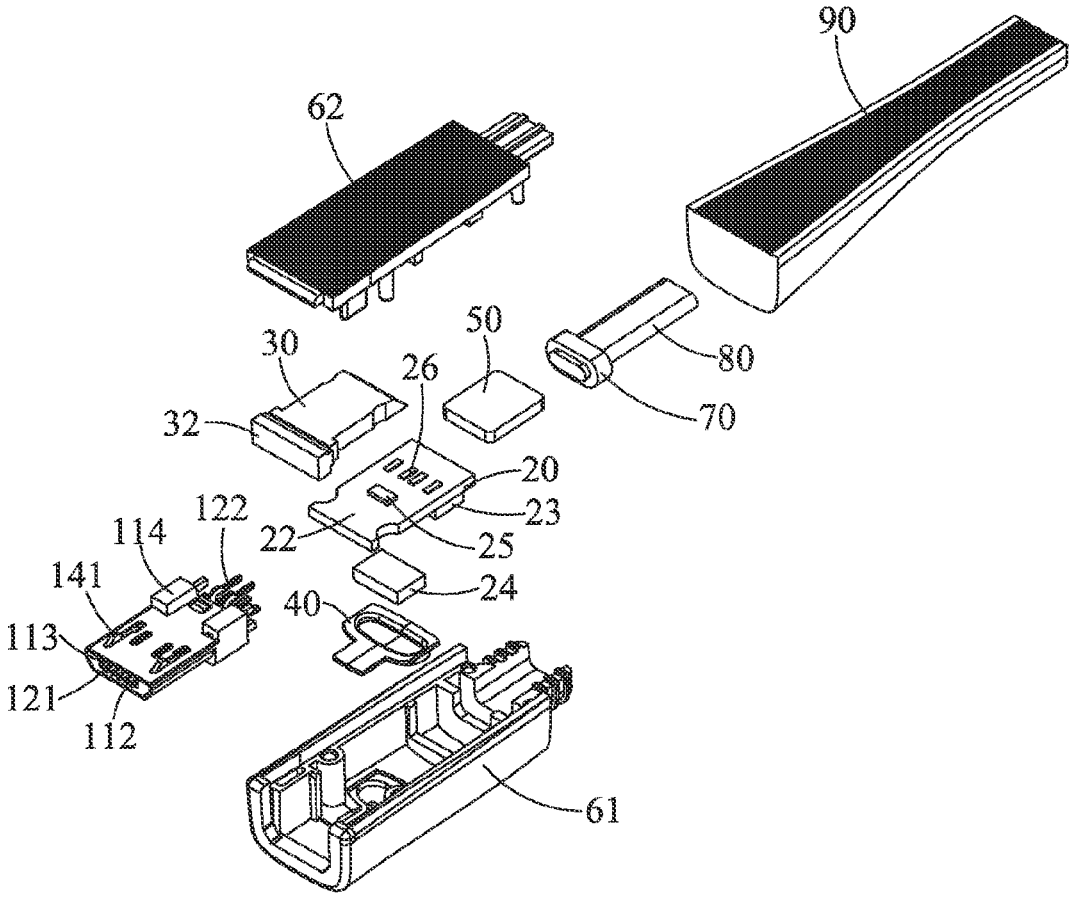
FIG. 6 is a view similar to FIG. 5, but viewed from a different aspect.

Referring to FIGS. 1 to 6, the present invention discloses an electrical connector assembly 100 in accordance with Micro USB plug standard for mating with a complementary connector (not shown), and the electrical connector assembly 100 includes a connector 10, an inner printed circuit board 20, a light guide member 30, a button member 40, a magnet 50, an insulative cover 60, a ring member 70, a cable 80 and an outer insulator 90. In an alternative embodiment, the electrical connector assembly 100 can be a receptacle connector.

The connector 10 comprises an insulative housing 11, a plurality of contacts 12, a metallic shell 13 and a pair of metallic latches 14. The insulative housing 11 comprises a base portion 111 and a tongue portion 112 extending forwards from the base portion 111, the metallic shell 13 is enclosing on the tongue portion 112 to form a mating cavity 113 for receiving the complementary connector. The contacts 12 are insert-molded with the insulative housing 11, thus the connector 10 can have a smaller profile, and the electrical connector assembly 100 can be designed with a low profile. Each contact 12 has a contacting portion 121 exposed in the mating cavity 113 and a soldering portion 122 extending beyond the insulative housing 11, and the soldering portions 122 are divided into two rows spaced from each other in an up-to-down direction.

The base portion 111 of the insulative housing 11 defines a pair of projections 114 on both sides thereof, and the projections 114 are extending beyond the corresponding surface of the metallic shell 13. Each metallic latch 14 has a locking tab 141 extending downwards and exposed beyond the metallic shell 13 to latch with the complementary connector.

The inner printed circuit board 20 defines a top plane 21 and a bottom plane 22 opposite to each other, the soldering portions 122 of the contacts 12 are soldered on the top plane 21 and the bottom plane 22, the cable 80 is soldered on the bottom plane 22 to electrically connect with the contacts 12. A control module 23 is disposed on the top plane 21, and a touch switch 24 is arranged in front of the control module 23. An LED 25 is disposed on the bottom plane 22, and a plurality of connecting fingers 26 are arranged behind the LED 25, the connecting fingers 26 are soldered with the cable 80. The touch switch 24 has a key 241 extending upwardly, and the LED 25 can be illuminated by pressing the key 241. The control module 23 has a chip inside to control the luminous effect of the LED 25.

The light guide member 30 is an euphotic element to indicate the status of the LED 25 such that users can observe the status of the LED 25. The light guide member 30 is made of transparent or semitransparent material, such as plastic, silicone or rubber, etc. A rear segment of the light guide member 30 is located under and separated from the LED 25, and according to the light reflection principle, a rear end of the light guide member 30 is designed at a 45 degree angle relative to a horizontal plane, thus light from LED 25 can be divergent forwards. The light guide member 30 is abutting upwardly against the projections 114 of the insulative housing 11, and extending beyond a front end of the base portion 111 of the insulative housing 11. An expansion 31 is defined in the front of the light guide member 30, the expansion 31 is located in front of the base portion 111 and abutting upwardly against the metallic shell 13. A front end 32 of the light guide member 30 is a vertical plane.

The button member 40 is made of silicone, and comprises a plate 41 and a convex portion 42 extending upwards from the plate 41. The plate 41 has a greater hardness than the convex portion 42, and the plate 41 is made of hard rubber, the convex portion 42 is made of soft rubber. The plate 41 has a bigger cross section than that of the convex portion 42 along a horizontal direction. The key 241 of the touch switch 24 is aligned with and received in the convex portion 42, and a top end of the key 24 is abutting against the convex portion 42, the key 241 is pressed by pushing the convex portion 42 downwardly.

The magnet 50 is assembled or inserted-molded in the insulative cover 60, thus to make the electrical connector assembly 100 attract other connectors by an attraction of the magnet 50. The magnet 50 is located below the inner printed circuit board 20 and behind the LED 25, and spaced apart from the connecting fingers 26.

The insulative cover 60 is made of plastic material, and includes an upper cover 61 and a lower cover 62, the upper cover 61 and the lower cover 62 are firstly assembled to each other, and then ultrasonic welding with each other. A rear section of the connector 10 is received in the insulative cover 60, and sandwiched between the upper cover 61 and the lower cover 62. Specifically, the base portion 111 of the insulative housing 11 is received in the insulative cover 60, the tongue portion 112 is exposed out of the insulative cover 60. The inner printed circuit board 20, the light guide member 30 and the button member 40 are accommodated in the insulative cover 60, the front end 32 of the light guide member 30 is flush with that of the insulative cover 60, and exposed on a front surface of the insulative cover 60, thus users can observe whether the light guide member 30 is luminous intuitively. As the upper cover 61 is ultrasonic welding with the lower cover 62 to form a seamless combination, on the one hand, the bonding strength therebetween can be increased, on the other hand, the volume of the insulative cover 60 can be reduced, so that the electrical connector assembly 100 can have a tiny profile.

The button member 40 is formed with the upper cover 61, and a through hole 611 is defined on a top surface of the upper cover 61. The convex portion 42 of the button member 40 is inserted into the through hole 611 and extending beyond the top surface of the upper cover to be pushed down by users. Additionally, the periphery of the convex portion 42 is molded together with inner walls of the through hole 611. The magnet 50 is assembled or inserted-molded in the lower cover 62.

The ring member 70 is enclosing on the cable 80 and located in the insulative cover 60, and the ring member 70 is retained by the upper cover 61 and the lower cover 62, thus the cable 80 is limited to moving backwards, the cable 80 can be prevented from being separated from the inner printed circuit board 20, thus can make a reliable and stable connection between the cable 80 and the contacts 20.

The cable 80 is extending beyond the insulative cover 60 and enclosed in the outer insulator 90, and the outer insulator 90 is over-molded on the insulative cover 60 to make the cable 80 combine with the insulative cover 60. The outer insulator 90 is made of silicone, so the outer insulator 90 is soft and flexible with a comfortable feel.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector assembly, comprising:

a connector comprising an insulative housing defining a tongue, a metallic shell enclosing the tongue, and a plurality of contacts received in the insulative housing, and each contact having a contacting portion and a soldering portion;

an inner printed circuit board welding with the soldering portions of the contacts, and defining a light emitting diode (LED); and a light guide member made of transparent or semitransparent material, neighboring to the LED and exposed out of the electrical connector assembly; wherein the inner printed circuit board defines a control module thereon for controlling the LED on or off and a touch switch arranged in front of the control module and pressed by pushing a button member, the LED is electrically connected with the control module and the touch switch;

along an up-to-down direction, said metallic shell is sandwiched between the light guide member and an upper cover which defines a through hole for outwardly extension of the button member.

2. The electrical connector assembly as claimed in claim 1, further comprising an insulative cover receiving the inner printed circuit board, wherein the insulative cover comprises said upper cover and a lower cover, the upper cover and the lower cover are firstly assembled to each other, and then ultrasonic welding with each other.

3. The electrical connector assembly as claimed in claim 2, wherein the button member comprises a plate and a convex portion extending upwards from the plate, the plate has a greater hardness than the convex portion.

4. The electrical connector assembly as claimed in claim 3, wherein said through hole is defined on the top surface of the upper cover, the convex portion is inserted into the through hole and extending beyond a top surface of the upper cover.

5. The electrical connector assembly as claimed in claim 4, wherein the touch switch has a key extending upwardly, and the LED can be illuminated by pressing the key, the key is aligned with and received in the convex portion.

6. The electrical connector assembly as claimed in claim 5, wherein a top end of the key is abutting against the convex portion, the key is pressed by pushing the convex portion down.

7. The electrical connector assembly as claimed in claim 4, wherein the button member is formed with the upper cover, and the periphery of the convex portion is molded together with inner walls of the through hole.

8. The electrical connector assembly as claimed in claim 2, wherein a front end of the light guide member is flush with that of the insulative cover, and exposed on a front surface of the insulative cover, the front end is a vertical plane, the connector is extending forwards beyond the insulative cover.

9. The electrical connector assembly as claimed in claim 2, wherein a rear segment of the light guide member is located under and separated from the LED, and a rear end of the light guide member is designed at a 45 degree angle relative to a horizontal plane, thus light from the LED can be divergent forwards.

10. The electrical connector assembly as claimed in claim 2, wherein the insulative housing comprises a base portion and said tongue portion extending forwards from the base portion, said metallic shell is enclosing on the tongue portion to form a mating cavity for receiving a complementary connector, the contacting portions are exposed in the mating cavity.

11. The electrical connector assembly as claimed in claim 10, wherein the base portion is accommodated in the insulative cover, and defines a pair of projections on both sides thereof, the projections are extending beyond the corresponding surface of the metallic shell, the light guide member defines an expansion in the front thereof, the expansion is located in front of the projections and abutting against the metallic shell.

12. The electrical connector assembly as claimed in claim 2, further comprising a magnet, wherein the magnet is assembled or inserted-molded in the insulative cover.

13. The electrical connector assembly as claimed in claim 3, wherein the electrical connector assembly is a universal serial bus (USB) plug, and further comprises a cable soldered on the inner printed circuit board to electrically connected with the contacts, and an outer insulator overmolded on the insulative cover to make the cable combine with the insulative cover.

14. The electrical connector assembly as claimed in claim 13, wherein the outer insulator is made of silicone, and the convex portion is made of soft rubber.

15. An electrical connector assembly comprising:

a connector having an insulative housing, a plurality of contacts received in the insulative housing and a metallic shell enclosing on the insulative housing;

an inner printed circuit board defining a top plane and a bottom plane opposite to each other, a control module and a touch switch disposed on the top plane, a light emitting diode (LED) and a plurality of connecting fingers disposed on the bottom plane;

a light guide member made of transparent or semitransparent material, and disposed below the LED, the light guide member having an expansion in the front thereof, the expansion abutting against the metallic shell, a back section of the light guide member abutting against a pair of projections of the insulative housing, a rear end of the light guide member designed at a 45 degree relative to a horizontal plane, a rear face of the rear end facing downwardly and rearwardly;

an insulative cover receiving the inner printed circuit board and the light guide member, and comprising an upper cover and a lower cover forming an inclining portion corresponding to the rear end of the light guide member; and a cable soldered with the connecting fingers to be electrically connected with the contacts.

16. The electrical connector assembly as claimed in claim 15, wherein the upper cover and the lower cover are firstly assembled to each other, and then ultrasonic welding with each other.

17. The electrical connector assembly as claimed in claim 15, wherein the touch switch is arranged in front of the control module, soldering portions of the contacts are divided into two rows spaced from each other in an up-to-down direction, and soldered on the top plane and the bottom plane, the connecting fingers are arranged behind the LED.

18. The electrical connector assembly as claimed in claim 15, wherein a front end of the expansion is flush with that of the insulative cover, and exposed on a front surface of the insulative cover.

19. An electrical connector assembly comprising:

a connector having an insulative housing and a plurality of contacts insert-molded with the insulative housing;

an inner printed circuit board sandwiched by tail portions of the contacts, and having a light emitting diode (LED) on one side thereof, a control module and a touch switch disposed on opposite side, the touch switch located in front of the control module and having a key extending upwardly, the LED can be illuminated by pressing the key;

a light guide member abutting against the connector and located below the inner printed circuit board, the LED shielded by and spaced apart from the light guide member;

an insulative cover enclosing on a rear segment of the connector and the inner printed circuit board and comprising an upper cover defining a through hole and a lower cover; and a button member comprising a plate and a convex portion arching upwards from the plate, the key aligned with and received in the convex portion, and a top end of the key abutting against the convex portion, the convex portion extending into the through hole of the insulative cover, the button member formed with the upper cover, and the periphery of the convex portion molded together with inner walls of the through hole.

20. The electrical connector assembly as claimed in claim 19, further comprising a magnet assembled or inserted-molded in the insulative cover, wherein the magnet is located below the inner printed circuit board and behind the LED, thus to make the electrical connector assembly attract other connectors.

* * * * *